United States Patent [19]

Koumura

[11] Patent Number: 4,549,518

[45] Date of Patent: Oct. 29, 1985

[54] METHOD OF CONTROLLING OPERATING AMOUNTS OF OPERATION CONTROL MEANS FOR AN INTERNAL COMBUSTION ENGINE

[75] Inventor: Takashi Koumura, Saitama, Japan

[73] Assignee: Honda Giken Kogyo Kabushiki Kaisha, Tokyo, Japan

[21] Appl. No.: 663,000

[22] Filed: Oct. 19, 1984

[30] Foreign Application Priority Data

Oct. 20, 1983 [JP] Japan ..... 58-196892

[51] Int. Cl.[4] ..... F02M 5/02

[52] U.S. Cl. ..... 123/478; 123/494

[58] Field of Search ..... 123/478, 480, 494

[56] References Cited

U.S. PATENT DOCUMENTS

| | | | |
|---|---|---|---|
| 4,155,332 | 5/1979 | Yaegashi et al. | 123/478 X |
| 4,332,226 | 6/1982 | Nomura et al. | 123/494 |
| 4,495,925 | 1/1985 | Hasegawa | 123/480 |

*Primary Examiner*—Tony M. Argenbright
*Attorney, Agent, or Firm*—Lyon & Lyon

[57] ABSTRACT

A method of controlling an operating amount of an operation control means for controlling the operation of an internal combustion engine. The operating amount is controlled in a first arithmetic manner determined on the basis of a first operating parameter of the engine during operation in a predetermined operating condition, while it is controlled in a second arithmetic manner determined on the basis of a second operating parameter of the engine during operation in a condition other than the predetermined operating condition. A first correction value appropriate to the first arithmetic manner and a second correction value appropriate to the second arithmetic manner are determined as a function of intake air temperature of the engine, respectively, during engine operation in the above predetermined operating condition, and during engine operation in another operating condition. Preferably, the first operating parameter of the engine is the opening area of the intake passage, while the second operating parameter is pressure in the intake passage at a location downstream of the intake air quantity control means. Also preferably, the first correction value is set to a value as a function of the temperature of intake air upstream of the intake air quantity control means, whereas the second correction value is set to a value as a function of the temperature of intake air downstream of the intake air quantity control means.

7 Claims, 5 Drawing Figures

METHOD OF CONTROLLING OPERATING AMOUNTS OF OPERATION CONTROL MEANS FOR AN INTERNAL COMBUSTION ENGINE

BACKGROUND OF THE INVENTION

This invention relates to a method of controlling the operating amount of an operation control means for an internal combustion engine, and more particularly to a method of this kind which is adapted to correct a desired or target value of the operating amount of such operation control means in a simple and inexpensive manner responsive to the temperature of intake air being supplied to the engine for improvement of the driveability of the engine over all operating regions of the engine inclusive of low load operating regions such as an idling region.

A method has been proposed, e.g. by Japanese Provisional Patent Publications (Kokai) Nos. 58-88436 and 53-8434, which determines a basic operating amount of operation control means for controlling the operation of the engine, such as a basic fuel injection amount to be supplied to the engine by a fuel supply quantity control system, a basic value of spark ignition timing to be controlled by an ignition timing control system, and a basic recirculation amount of exhaust gases to be controlled by an exhaust gas recirculation control system, in dependence on values of engine operating parameters indicative of loaded conditions of the engine, such as absolute pressure in the intake pipe of the engine and engine rotational speed, and corrects the basic operating amount thus determined in response to the temperature of intake air being supplied to the engine, to thereby set a desired operating amount for the operation control means with accuracy.

However, while the engine is operating in a low load condition such as at idle, the intake pipe absolute pressure has a reduced rate of change relative to the lapse of time with respect to a rate of change in the engine rotational speed relative to the lapse of time. Therefore, according to the above proposed method of determining operating amounts of the operation control means in dependence on the intake pipe absolute pressure and the engine rotational speed (generally called "the speed density method", and hereinafter merely referred to as "the SD method"), it is difficult to set with accuracy an operating amount such as a fuel supply quantity in accordance with the state of condition of the engine, thus causing hunting of the engine rotation, during operation of the engine in such a low load condition. In view of the foregoing, a method (hereinafter merely called "the KMe method") has been proposed, e.g. by Japanese Patent Publication No. 52-6414, which is based upon the recognition that the quantity of intake air passing the throttle valve is not dependent upon either of pressure PBA in the intake pipe downstream of the throttle valve and pressure of the exhaust gases while the engine is operating in a particular low load condition wherein the ratio PBA/PA' of intake pipe pressure PBA downstream of the throttle valve to intake pipe pressure PA' upstream of the throttle valve is below a critical pressure ratio (=0.528) at which the intake air forms a sonic flow, and accordingly the quantity of intake air can be determined solely in dependence on the valve opening of the throttle valve, if the intake pipe pressure PA' upstream of the throttle valve remains constant. Therefore, this proposed method detects the valve opening of the throttle valve alone to thereby detect the quantity of intake air with accuracy while the engine is operating in the above-mentioned particular low load condition, and then sets an operating amount such as a fuel injection quantity on the basis of the detected value of the intake air quantity.

Also a value of an operating amount determined by the above KMe method requires correction responsive to a change in the intake air temperature in a manner proper to the KMe method different from a manner of correction applied to the SD method. That is, while according to the SD method the detection of the intake air temperature should desirably be made at a location as close to the intake valve as possible, such detection according to the KMe method has to be made at a location immediately upstream of the throttle valve, because the flow rate of intake air in gravity or weight intrinsically varies in response to a change in the temperature of intake air immediately upstream of the throttle valve. However, if both the SD method and the KMe method are employed for correcting an operating amount in response to the intake air temperature in a selective manner dependent upon loaded conditions of the engine, to provide two separate intake air temperature sensors for respective exclusive use for these methods will render the control system complicate in structure and result in an increased manufacturing cost.

SUMMARY OF THE INVENTION

It is the object of the invention to provide a method of controlling the operating amount of an operation control means for controlling an internal combustion engine, which employs both of the SD method and the KMe method for determining the operating amount, and is capable of correcting the values of operating amounts determined by these methods in response to the intake air temperature, in respective appropriate manners to these methods, so as to set the operating amount with accuracy throughout the whole operating region of the engine inclusive of low load conditions of the engine such as an idling condition, thereby contributing to improvement of the driveability of the engine.

The present invention provides a method of controlling an operating amount of an operation control means for controlling the operation of an internal combustion engine. The operating amount of the operation control means is controlled in a first arithmetic manner to a first desired value determined on the basis of a first operating operating parameter of the engine when the engine is operating in a predetermined operating condition, while it is controlled in a second arithmetic manner to a second desired value determined on the basis of a second operating parameter of the engine when the engine is operating in a condition other than the above predetermined operating condition.

The method according to the invention is characterized by comprising the following steps:

(1) detecting the temperature of intake air being supplied to the engine;

(2) when the engine is operating in the above predetermined operating condition, determining a first correction value appropriate to the first arithmetic manner, as a function of the detected value of the intake air temperature, correcting the first desired value of operating amount by the use of the determined first correction value, and controlling the operating amount of the operation control means to the corrected first desired value; and (3) when the engine is operating in a condition other than the above predetermined operating condition, determining a second correction value appropriate to the second arithmetic manner, as a function of the detected value of the intake air temperature, correcting the second desired value of operating amount by the use of the determined second correction value, and controlling the operating amount of the operation control means to the corrected second desired value.

Preferably, the engine has an intake passage, and an intake air quantity control means arranged in the intake passage for adjusting the opening area of the intake passage, and wherein the first operating parameter of the engine is the opening area of the intake passage which is adjusted by the intake air quantity control means, while the second operating parameter of the engine is pressure in the intake passage at a location downstream of the intake air quantity control means.

Further, preferably, the first correction value is set to a value as a function of the temperature of intake air upstream of the intake air quantity control means, whereas the second correction value is set to a value as a function of the temperature of intake air downstream of the intake air quantity control means. Preferably, the detection of intake air temperature in the step (1) is effected at one of an upstream side of the intake air quantity control means and a downstream side thereof. Preferably, the aforesaid predetermined operating condition of the engine is a low load condition of the engine. Also preferably, the aforesaid operation control means is a fuel supply quantity control means, wherein the aforesaid operating amount is a quantity of fuel being supplied to the engine by the fuel supply quantity control means.

The above and other objects, features, and advantages of the invention will be more apparent from the ensuing detailed description taken in conjunction with the accompanying drawings.

DETAILED DESCRIPTION

Figure 1:
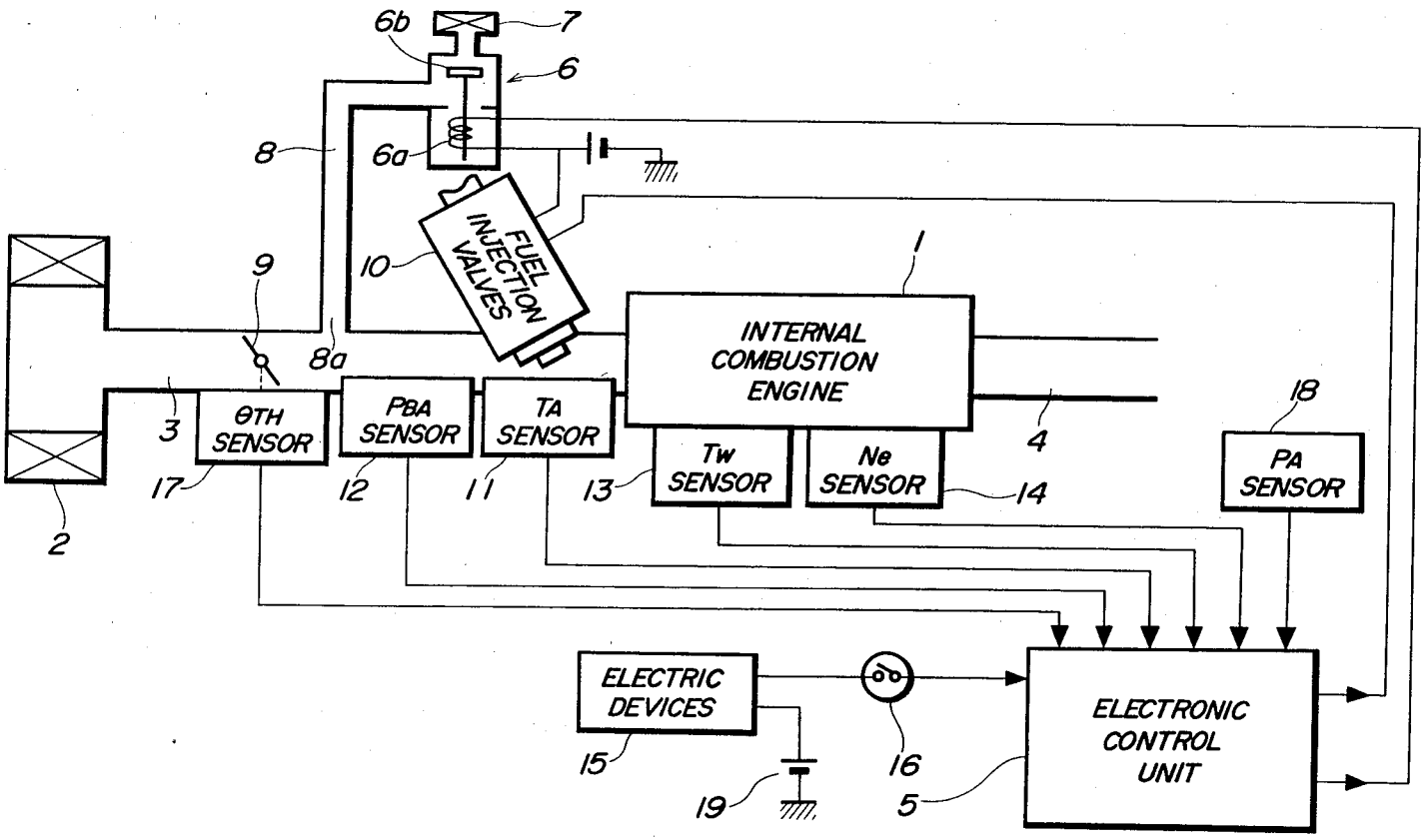
FIG. 1 is a block diagram of the whole arrangement of a fuel injection control system for an internal combustion engine, to which is applied the method according to the present invention.

The invention will now be described in detail with reference to the drawings showing an embodiment thereof.

As an example for correcting in dependence on intake air temperature an operating amount of an operation control means for an internal combustion engine, e.g. the fuel supply quantity, which is determined by the SD method, a method has been disclosed in U.S. Pat. No. 4,465,051, which multiplies a basic fuel injection period Ti determined as a function of intake passage absolute pressure and engine rotational speed by the following correction coefficient KTA1:

$$KTA1 = \frac{1}{1 + CTAMAP(TA - TA0)}$$

where TA represents the temperature (°C.) of intake air flowing in the intake pipe, and TA0 a calibration variable, which is set e.g. at 50° C., respectively. CTAMAP represents a calibration coefficient having its value set at a constant value (e.g. $1.26\times10^{-3}$) in dependence upon the operating characteristics of the engine. In the above equation, since the value of CTAMAP(TA−TA0) is smaller than 1, the coefficient KTA1 can be approximately determined by the following equation:

$$KTA1 = 1 - CTAMAP(TA - TA0) \quad (1)$$

When the ratio (PBA/PA') of intake pipe pressure PBA downstream of the throttling portion such as a throttle valve to intake pipe pressure PA' upstream of the throttling portion is smaller than the critical pressure ratio (=0.528), intake air passing the throttling portion forms a sonic flow. The flow rate Ga(g/sec) of intake air can be expressed as follows:

$$Ga = A \times C \times PA \times \sqrt{\left(\frac{2}{\kappa + 1}\right)^{\frac{\kappa+1}{\kappa-1}} \times \frac{g\kappa}{R(TAF + 273)}} \quad (2)$$

where A represents the equivalent opening area ($mm^2$) of the throttling portion such as the throttle valve, C a correction coefficient having its value determined by the configuration, etc. of the throttling portion, PA atmospheric pressure (PA=PA', mmHg), $\kappa$ the ratio of specific heat of air, R the gas constant of air, TAF the temperature (°C.) of intake air immediately upstream of the throttling portion, and g the gravitational acceleration ($m/sec^2$), respectively.

In the aforementioned equation, the ratio of the flow rate Ga0 of intake air assumed when the temperature of air upstream of the throttling portion is equal to a reference temperature TAF0, to the flow rate Ga of intake air at a given temperature TAF can be given by the following equation:

$$\frac{Ga}{Gao} = \sqrt{\frac{TAF0 + 273}{TAF + 273}}$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same at the reference temperature TAF0, as expressed by the following equation:

$$Gf = Gf0\sqrt{\frac{TAF0 + 273}{TAF + 273}}$$

Here, the intake air temperature-dependent correction coefficient KTA2 value can be expressed as follows:

$$KTA2 \approx \sqrt{\frac{TAF0 + 273}{TAF + 273}}$$

Therefore, the correction coefficient KTA2 value can be approximated by the following equation:

$$KTA2 \approx 1 - \frac{TAF - TAF0}{2(TAF + 273)} \approx 1 - \alpha(TAF - TAF0) \quad (3)$$

Thus, the above correction coefficient KTA2 value is determined as a function of the temperature TAF of intake air upstream of the throttling portion. It has been experimentally ascertained that the functional relationship between the intake air temperature TAF upstream of the throttling portion and the intake air temperature TA downstream of same is approximated by the following equation, when the engine is in an idling condition:

$$TAF = a \times TA + b \quad (4)$$

where a and b represent constants. Taking the relationship of $TAF0 = a \times TA0 + b$ into consideration, the equation (3) can be expressed as follows, by substituting the equation (4) into the equation (3):

$$\begin{aligned} KTA2 &= 1 - a \times \alpha(TA - TA0) \\ &= 1 - CTAC(TA - TA0) \end{aligned} \quad (5)$$

Therefore, by multiplying a value of the fuel flow rate determined by the KMe method at the reference intake air temperature by a value of the correction coefficient KTA2 determined by the equation (5), it is possible to obtain a proper value of the fuel flow rate required to be supplied to the engine at the actual intake air temperature TA.

FIG. 1 schematically illustrates the whole arrangement of a fuel injection control system for internal combustion engines, to which is applied the method according to the invention. In the figure, reference numeral 1 designates an internal combustion engine which may be a four-cylinder type. Connected to the engine 1 are an intake pipe 3 with its air intake end provided with an air cleaner 2 and an exhaust pipe 4. Arranged in the intake pipe 3 is a throttle valve 9, and an air passage 8 opens at one end 8*a* into the intake pipe 3 at a downstream side of the throttle valve 9 and communicates with the atmosphere through the other end. The air passage 8 has an air cleaner 7 provided at the other end opening in the atmosphere. Arranged across the air passage 8 is a supplementary air quantity control valve (hereinafter merely called "the control valve") 6 which is a normally closed type electromagnetic valve comprising a solenoid 6*a* and a valve body 6*b* disposed to open the air passage 8 when the solenoid 6*a* is energized, the solenoid 6*a* being electrically connected to an electronic control unit (hereinafter abbreviated as "the ECU") 5.

Fuel injection valves 10 are projected into the intake pipe 3 at a location between the engine 1 and the open end 8*a* of the air passage 8, and connected to a fuel pump, not shown, and also electrically connected to the ECU 5.

A throttle valve opening ($\theta$TH) sensor 17 is connected to the throttle valve 9, while an intake air temperature (TA) sensor 11 and an intake pipe absolute pressure (PBA) sensor 12 are mounted in the intake pipe 3 at locations downstream of the open end 8*a* of the air passage 8. Further, the main body of the engine 1 is provided with an engine cooling water temperature (TW) sensor 13 and an engine rotational speed (Ne) sensor 14. These sensors are electrically connected to the ECU 5. Reference numeral 15 represents electrical devices such as headlights, a brake lamp, an electric motor for driving a radiator cooling fan. One terminal of each of these electrical devices 15 is electrically connected to the ECU 5 by way of a switch 16, while another terminal thereof is electrically connected to a battery 19. Reference numeral 18 designates a sensor for sensing another engine operating parameter, for instance, an atmospheric pressure sensor, also electrically connected to the ECU 5.

The operation of the fuel injection control system constructed as above will now be described.

The ECU 5 is supplied with signals indicative of operating parameter values of the engine from the throttle valve opening sensor 17, the intake air temperature sensor 11, the intake pipe absolute pressure sensor 12, the engine cooling water temperature sensor 13, the engine rotational speed sensor 14, and the another engine parameter sensor 18. The ECU 5 operates on these engine operating parameter signals and signals indicative of electrical loads from the electrical devices 15 to determine whether or not the engine is operating in an operating condition requiring the supply of supplementary air to the engine, and set a desired idling speed value. When the engine is determined to be operating in such supplementary air-supplying condition, the ECU 5 determines the quantity of supplementary air to be supplied to the engine in response to the difference between the set desired idling speed value and the actual engine rotational speed, so as to make the same difference zero, and thereby calculates a value of the valve opening duty DOUT ratio for the control valve 6 to drive the same valve with the calculated duty ratio.

The solenoid 6*a* of the control valve 6 is energized for a valve opening period of time corresponding to the calculated valve opening duty ratio DOUT to open the valve body 6*b* to open the air passage 8 so that a required quantity of air determined by the valve opening period of the valve 6 is supplied to the engine 1 through the air passage 8 and the intake pipe 3.

If the valve opening period for the control valve 6 is set to a larger value so as to increase the supplementary air quantity, an increased quantity of the mixture is supplied to the engine 1 to thereby increase its output so that the engine rotational speed increases. On the contrary, if the valve opening period is set to a smaller value, it results in a reduced mixture quantity and accordingly a decrease in the engine rotational speed. By controlling the supplemtary air quantity, that is, the valve opening period for the control valve 6 in this manner, the engine rotational speed can be maintained at the desired idling speed value during idling operation of the engine.

On the other hand, the ECU 5 also operates on values of the aforementioned various engine operating parameter signals and in synchronism with generation of pulses of a TDC signal indicative of top-dead-center positions of the engine cylinders, which may be supplied from the engine rotational speed sensor 14, to calculate the fuel injection period TOUT for the fuel injection valves 10 by the use of the following equation:

$$TOUT = Ti \times K1 + K2 \quad (6)$$

where Ti represents a basic fuel injection period, which is determined according to the aforementioned SD method or the KMe method, selected depending upon whether or not the engine is operating in an operating region wherein a predetermined idling condition is fulfilled, as hereinafter described in detail.

In the above equation, K1 and K2 represent correction coefficients or correction variables which are calculated on the basis of values of engine operating parameter signals supplied from the aforementioned various sensors such as the engine cooling water temperature (TW) sensor 13, the throttle valve opening ($\theta$TH) sensor 17, and the intake air temperature (TA) sensor 11. For instance, the correction coefficient K1 is calculated by the use of the following equation:

$$K1 = KTA \times KTW \times KWOT \quad (7)$$

where KTA represents an intake air temperature-dependent correction coefficient, described in detail hereinafter, and KTW represents a coefficient for increasing the fuel supply quantity, which has its value determined in dependence on the engine cooling water temperature TW sensed by the engine cooling water temperature (TW) sensor 13, and KWOT a mixture-enriching coefficient applicable at wide-open-throttle operation of the engine and having a constant value, respectively.

The ECU 5 supplies the fuel injection valves 10 with driving signals corresponding to the fuel injection period TOUT calculated as above, to open the same valves.

Figure 2:
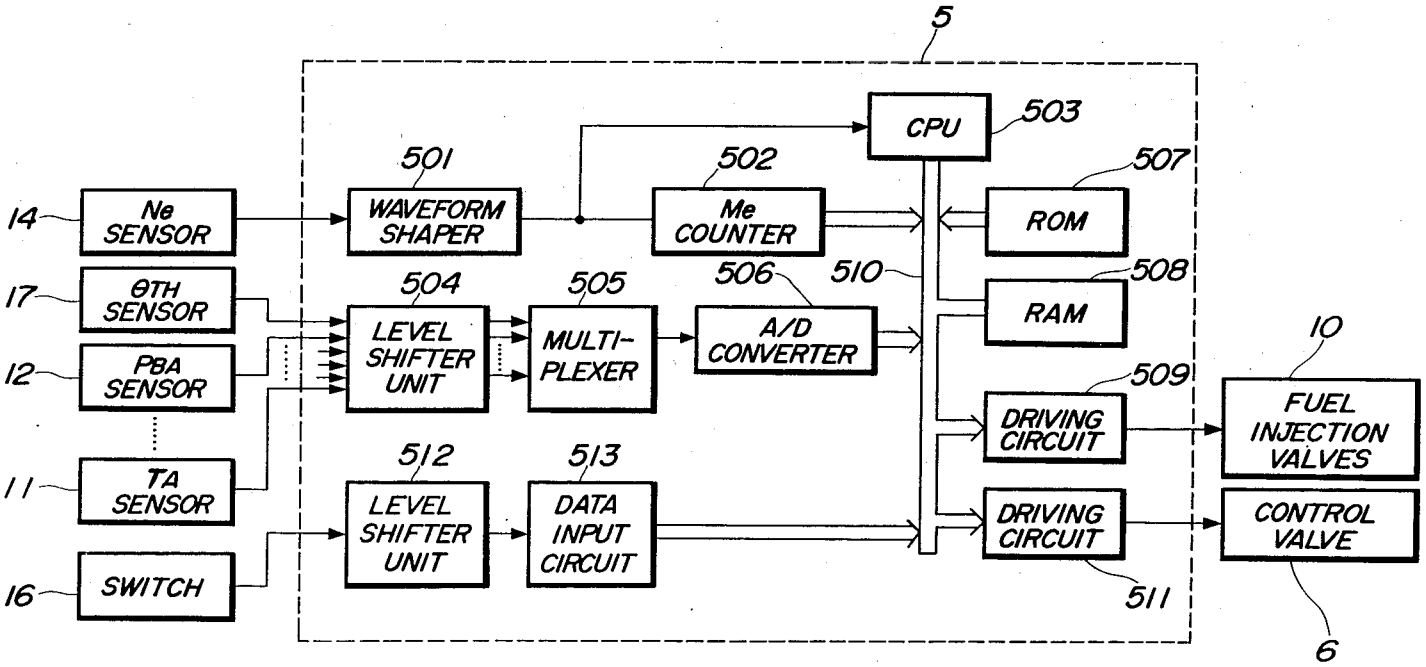
FIG. 2 is a block diagram of the interior construction of an electronic control unit (ECU) appearing in FIG. 1.

FIG. 2 shows a circuit configuration within the ECU 5 in FIG. 1. An output signal from the engine speed (Ne) sensor 14 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal and a present pulse of same, inputted thereto from the Ne sensor 14, and therefore its counted value Me is proportional to the reciprocal of the actual engine speed Ne. The Me value counter 502 supplies the counted value Me to the CPU 503 via a data bus 510.

The respective output signals from the throttle valve opening ($\theta$TH) sensor 17, the intake pipe absolute pressure (PBA) sensor 12, the engine cooling water temperature (TW) sensor 13, the intake air temperature (TA) sensor 11, etc., appearing in FIG. 1 have their voltage levels shifted to a predetermined voltage level by a level shifter unit 504 and successively applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

On-off state signals supplied from the switches 16 of the electrical devices 15 in FIG. 1 are supplied to another level shifter unit 512 wherein the signals have their voltage levels shifted to a predetermined voltage level, and the level shifted signals are processed by a data input circuit 513 and applied to the CPU 503 through the data bus 510.

Further connected to the CPU 503 via the data bus 510 are a read-only memory (hereinafter called "the ROM") 507, a random access memory (hereinafter called "the RAM") 508 and driving circuits 509 and 511. The RAM 508 temporarily stores various calculated values from the CPU 503, while the ROM 507 stores a control program executed within the CPU 503, etc.

The CPU 503 operates in accordance with the control program stored in the ROM 507 to determine operating conditions of the engine on the basis of the engine operating parameter signals, as well as electrically loaded conditions of the engine on the basis of the on-off signals from the electrical devices 15, to calculate the valve opening duty ratio DOUT for the control valve 6 to a value corresponding to the determined loaded condition of the engine.

The CPU 503 supplies the driving circuit 511 with a control signal corresponding to the calculated valve opening duty ratio DOUT for the control valve 6, and then the driving circuit 511 operates on the control signal to apply a driving signal to the control valve 6 to drive same. The CPU 503 also operates on the various engine operating parmeter signals to calculate the valve opening period TOUT for the fuel injection valves 10, and supplies the driving circuit 509 with a control signal corresponding to the calculated valve opening period to cause same to apply driving signals to the fuel injection valves 10 to drive same.

Figure 4:
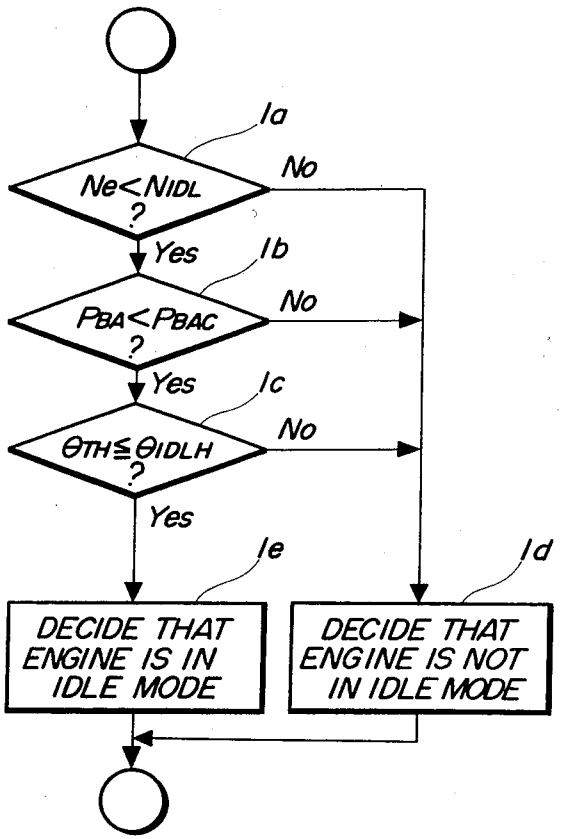
FIG. 4 is a flowchart showing a manner of determining whether or not the engine is operating in a predetermined operating condition.
Figure 3:
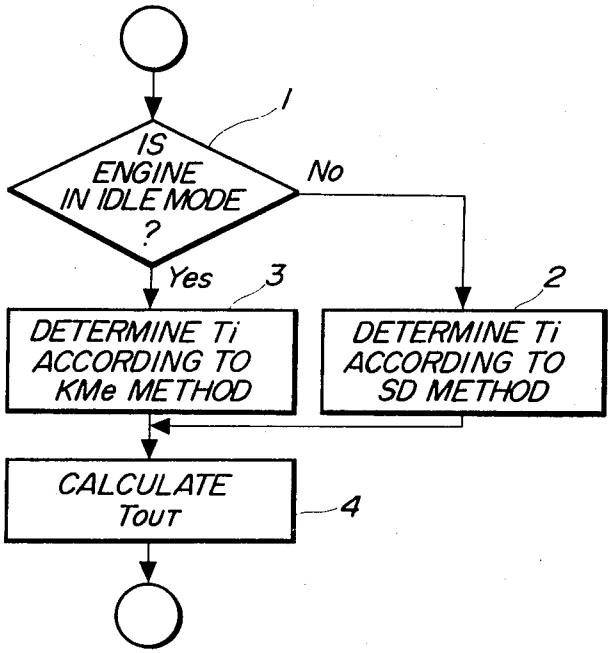
FIG. 3 is a flowchart showing a manner of calculating the valve opening period TOUT for the fuel injection valves.

FIG. 3 shows a manner of calculating the valve opening period TOUT for the fuel injection valves 10. First, in the step 1 of FIG. 3, it is determined whether or not is fulfilled a condition for applying the KMe method to calculation of the basic value Ti of the valve opening period 10 (hereinafter this condition will be called "the idle mode"). This determination as to fulfillment of the idle mode may be made by determining whether or not the engine is operating in a predetermined operating region as shown in the flowchart of FIG. 4, for instance. That is, in the step 1*a* of FIG. 4, it is determined whether or not the engine rotational speed Ne is lower than a predetermined value NIDL (e.g. 1,000 rpm). If the answer is negative or no, the program jumps to step 1*d* wherein a decision is rendered that the idle mode is not fulfilled. If the answer to the question at step 1*a*, the program proceeds to step 1*b* wherein it is determined whether or not the intake pipe absolute pressure PBA is lower than a predetermined reference value PBAC. The reference value PBAC is set at such a value as to determine whether or not the ratio of intake pipe absolute pressure PBA downstream of the throttle valve 9 to intake pipe absolute pressure PA' upstream of the throttle valve 9 is smaller than the critical pressure ratio (=0.528) at which the flow of intake air passing the throttle valve 9 forms a sonic flow. If the answer to the question of step 1*b* is negative or no, the fulfilment of the idle mode is negated at step 1*d*, while if the answer is affirmative, the program proceeds to step 1*c* to make a determination as to whether or not the valve opening $\theta$TH of the throttle valve 9 is smaller than a predetermined value $\theta$IDLH. That is, at a transition in engine operation from an idling condition with the throttle valve 9 in its substantially closed position to an accelerating condition with the throttle valve 9 rapidly opened, if this accelerating condition is detected solely from changes in the engine rotational speed and the intake pipe absolute pressure, there will occur a detection lag mainly due to the response lag of the absolute pressure sensor 12. Therefore, the throttle valve opening $\theta$TH is employed to detect such accelerating condition. When such accelerating condition is detected by the throttle valve opening sensor 17, the SD method, hereinafter referred to, is applied to calculation of a proper accelerating increased fuel quantity for supply to the engine. If the answer to the question of step 1c is negative, it is decided that the idle mode is not then fulfilled. If all the answers to the questions of steps 1a through 1c are found affirmative at the same time, the program proceeds to step 1e to decide that the engine is operating in the idle mode.

Referring again to FIG. 3, if the determination at step 1 provides a negative answer, the SD method is employed to determine the basic fuel injection period value Ti at step 2. According to the SD method, a basic fuel injection period value Ti is selected from among a plurality of predetermined values stored in the ROM 507 within the ECU 5, which corresponds to a combination of detected values of intake pipe absolute pressure PBA and engine rotational speed Ne. The basic fuel injection period value Ti thus determined is applied to the aforegiven equation (6) together with the intake air temperature-dependent correction coefficient KTA forming part of the correction coefficients K1, to calculate the final fuel injection period TOUT, at step 4.

If the answer to the question of step 1 is affirmative, the program proceeds to step 3 to employ the KMe method for calculation of the basic fuel injection period Ti.

The basic fuel injection period Ti according to the KMe method is determined by the following equation:

$$Ti = K(A) \times Me \quad (8)$$

where K(A) represents the equivalent opening area of the throttling portion in the intake passage, which is determined by the sum of the valve opening areas of the throttle valve 9 and the control valve 6. The valve opening areas of these valves 9, 6 may be obtained, respectively, from a value of the output signal from the throttle valve opening sensor 17 and a value of the valve opening duty ratio for the control valve 6 calculated by the CPU 503. In the equation (8), Me represents a time interval of generation of pulses of the TDC signal which is measured by the Me counter 502 in FIG. 2. The reason why the basic fuel injection period Ti can be determined by the use of the equation (8) above is as follows: The quantity of intake air passing the throttling portion of the intake passage per unit time is given solely as a function of the equivalent opening area of the throttling portion provided that the atmospheric pressure PA and the intake air temperature TAF remain constant, as endorsed by the equation (2). Further, the quantity of intake air sucked into an engine cylinder per suction stroke is proportional to the reciprocal of the engine rpm Ne, and accordingly to the Me value.

The basic fuel injection period value Ti thus determined is applied to the equation (6) to calculate the final fuel injection period TOUT, at step 4.

Figure 5:
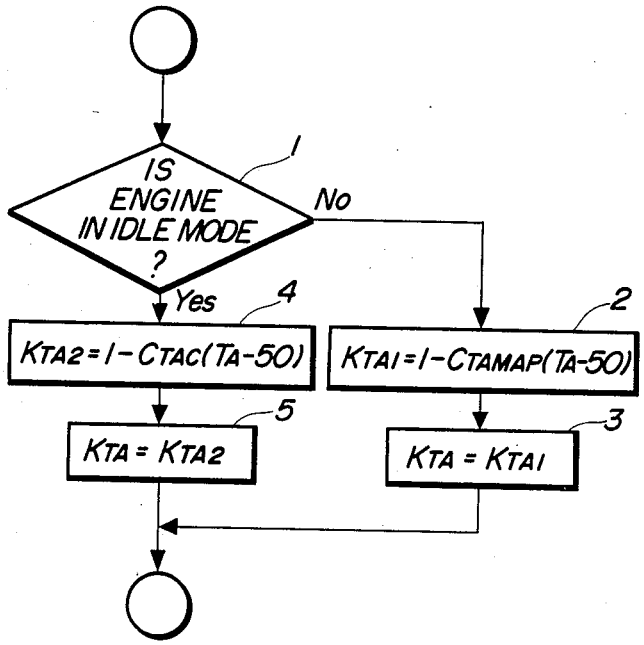
FIG. 5 is a flowchart showing a manner of calculating an intake air temperature-dependent correction coefficient KTA.

FIG. 5 shows a manner of calculating the intake air temperature-dependent correction coefficient KTA as part of the correction coefficients K1, appearing in the equation (7).

It is first determined in step 1 of FIG. 5 whether or not the engine is operating in the idle mode, as in step 1 of FIG. 3. If the answer is negative, the program proceeds to step 2 wherein the intake air temperature-dependent correction coefficient KTA1 is calculated by the use of the equation (1), to be applied to correction of the basic fuel injection period Ti determined according to the SD method. The coefficient KTA1 value thus determined is applied as the correction coefficient KTA to the equations (7) and (6), at step 3. If the answer to the question of step 1 is affirmative, the program proceeds to step 4 wherein the intake air temperature-dependent correction coefficient KTA2 is calculated by the use of the equation (5), to be applied to correction of the basic fuel injection period Ti determined according to the KMe method. The coefficient KTA2 value thus determined is applied as the correction coefficient KTA to the equations (7) and (6), at step 5.

The method according to the invention is not limited to control of the fuel supply quantity in a fuel supply control system for internal combustion engines as in the foregoing embodiment, but it may be applied to control of an operating amount of any operation control means for controlling the operation of an internal combustion engine, insofar as the operating amount is determined by the use of a parameter indicative of the intake air quantity. For instance, the method according to the invention may be applied to control of an operating amount of an ignition timing control system, and an exhaust gas recirculation control system.

What is claimed is:

1. A method of controlling an operating amount of an operation control means for controlling the operation of an internal combustion engine, wherein the operating amount of said operation control means is controlled in a first arithmetic manner to a first desired value determined on the basis of a first operating parameter of the engine when the engine is operating in a predetermined operating condition, while it is controlled in a second arithmetic manner to a second desired value determined on the basis of a second operating parameter of the engine when the engine is operating in a condition other than said predetermined operating condition, the method comprising the steps of:

(1) detecting the temperature of intake air being supplied to the engine;

(2) when the engine is operating in said predetermined operating condition, determining a first correction value appropriate to said first arithmetic manner, as a function of the detected value of the intake air temperature, correcting said first desired value of operating amount by the use of the determined first correction value, and controlling the operating amount of said operation control means to the corrected first desired value; and (3) when the engine is operating in a condition other than said predetermined operating condition, determining a second correction value appropriate to said second arithmetic manner, as a function of the detected value of the intake air temperature, correcting said second desired value of operating amount by the use of the determined second correction value, and controlling the operating amount of said operation control means to the corrected second desired value.

2. A method as claimed in claim 1, wherein said engine has an intake passage, and an intake air quantity control means arranged in said intake passage for adjusting the opening area of said intake passage, said first operating parameter of the engine being the opening area of said intake passage which is adjusted by said intake air quantity control means.

3. A method as claimed in claim 2, wherein said second operating parameter of the engine is pressure in said intake passage at a location downstream of said intake air quantity control means.

4. A method as claimed in claim 2, wherein said first correction value is set to a value as a function of the temperature of intake air upstream of said intake air quantity control means, and said second correction value is set to a value as a function of the temperature of intake air downstream of said intake air quantity control means.

5. A method as claimed in claim 4, wherein said detection of intake air temperature in said step (1) is effected at one of an upstream side of said intake air quantity control means and a downstream side thereof.

6. A method as claimed in claim 1, wherein said predetermined operating condition of the engine is a low load condition of the engine.

7. A method as claimed in claim 1, wherein said operation control means is a fuel supply quantity control means, said operating amount being a quantity of fuel being supplied to the engine by said fuel supply quantity control means.

* * * * *